United States Patent [19]

Cohn

[11] Patent Number: 4,995,936

[45] Date of Patent: Feb. 26, 1991

[54] CONTINUOUS WEB SPLICING MACHINE

[76] Inventor: Robert Cohn, 1210 Jackson St., Omaha, Nebr. 68102

[21] Appl. No.: 385,686

[22] Filed: Jul. 27, 1989

[51] Int. Cl.[5] ..... B65H 19/14; B65H 19/18; B65H 19/20

[52] U.S. Cl. ..... 156/504; 83/694; 156/159; 242/56 R; 242/58.3; 242/58.5

[58] Field of Search ..... 156/504, 505, 157, 159, 156/365, 368, 381; 242/58.1, 58.3, 58.5, 56 R; 83/553, 835, 853, 837, 855, 694, 692, 918

[56] References Cited

U.S. PATENT DOCUMENTS

| | | | |
|---|---|---|---|
| 2,771,120 | 11/1956 | Achilles | 156/381 |
| 2,864,446 | 12/1958 | Olson et al. | 83/694 |
| 2,987,108 | 6/1961 | Kilmartin | 156/159 |
| 3,858,819 | 1/1975 | Butler, Jr. | 156/504 |
| 4,190,483 | 2/1980 | Ryan et al. | 156/504 |
| 4,331,301 | 5/1982 | Martinez | 242/58.1 |
| 4,652,329 | 3/1987 | Focke | 156/505 |
| 4,669,380 | 6/1987 | Seib et al. | 101/216 |
| 4,757,951 | 7/1988 | Ludszeweit | 242/58.1 |

*Primary Examiner*—Michael G. Wityshyn
*Attorney, Agent, or Firm*—Evelyn M. Sommer

[57] ABSTRACT

A continuous web splicing machine has supports for rotatably mounting two rolls of sheet material in tandem, guides for guiding the sheets along upper and lower paths to a splicing station, and an output loopholder for holding a loop length so that the web is supplied continuously even during the spicing operation. The splicing station has upper and lower upstream holders, upper and lower downstream holders, and upper and lower cutters at the splicing station. The cutters and holders are selectively operable in automatic sequences so that fresh sheets can be spliced to the spent sheets alternatingly from the two roll supports. The cutter is formed with knife parts having serrated edges with hooked teeth for improved cutting action. The holder assemblies may be oriented vertically or in other suitable orientations.

12 Claims, 3 Drawing Sheets

56

33
53
54
2
15
53
49
22
9b
8b
6b
13b
7b
3
5b
9a
8a
6a
13a
7a
5a
3
1

CONTINUOUS WEB SPLICING MACHINE

FIELD OF THE INVENTION

This invention generally relates to a splicing machine, and more particularly, to one which is capable of splicing the end of one roll of sheet material to the beginning of another roll semi-automatically and without interruption of the running of the resulting continuous web.

BACKGROUND ART

In the packaging, converting, and food processing industries, packaging or wrapping materials are supplied via a continuous web at high running speeds to food processing stations. The web is provided from rolls of continuous sheet material which has a width that is relatively narrow according to the dimensions of the wrapped products, thereby limiting the amount of linear footage of sheet material wound on each roll. Therefore, it is desireable in these industries to be able to splice the end of one roll with the beginning of the next roll without interrupting the running of the continuous web to the food processing stations.

SUMMARY OF THE INVENTION

The continuous web splicing machine of the invention comprises: first and second supports for rotatably mounting first and second rolls of sheet material thereon, respectively; first and second guide means for guiding the first and second sheets from the first and second rolls, respectively, along first and second paths to a splicing station; the splicing station including holding means and cutting means; and output guide means for guiding a continuous web of sheet material from said splicing station, wherein said holding means of said splicing station includes a first holder for holding a leading end of a fresh one of said two sheets in a splicing position, said leading end having an adhesive layer thereon facing toward the other sheet, and a second holder which is operable to temporarily hold a spent other one of said two sheets with a portion disposed in the splicing position facing opposite the leading end of the fresh sheet, said cutting means being operable to cut off a trailing end of the spent sheet and adhesively join it to the leading end of the fresh sheet, and wherein said output guide means includes a loop holder for holding a loop of the output web of sufficient length so that the web is continuously output even while the spent sheet is temporarily held during the splicing operation.

The preferred embodiment of the invention includes opposing pairs of holders and cutters at the splicing station which are selectively operable so that fresh sheets can be spliced alternatingly from the first and second roll supports, and pneumatic controls for brakes for the roll supports and the loop holder. The cutter is formed with knife parts having serrated edges with hooked teeth for improved cutting action.

Other objects, features, and advantages of the present invention will become apparent from the following detailed description of the best mode of practising the invention when considered in conjunction with the drawings, as follows:

DESCRIPTION OF THE PREFERRED EMBODIMENT

Figure 1:
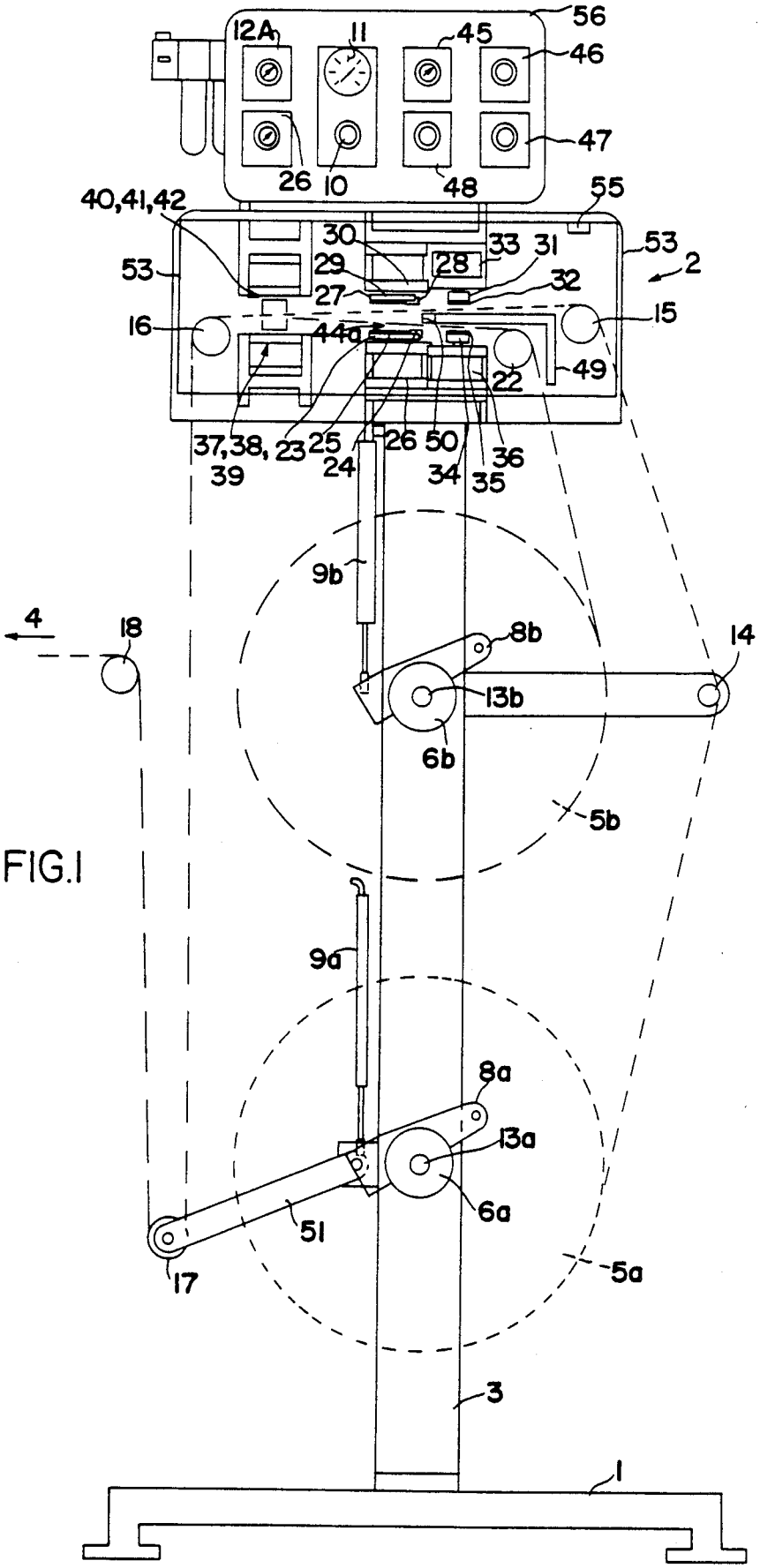
FIG. 1 is a front schematic view of a continuous web splicing machine in accordance with the invention.
Figure 2:
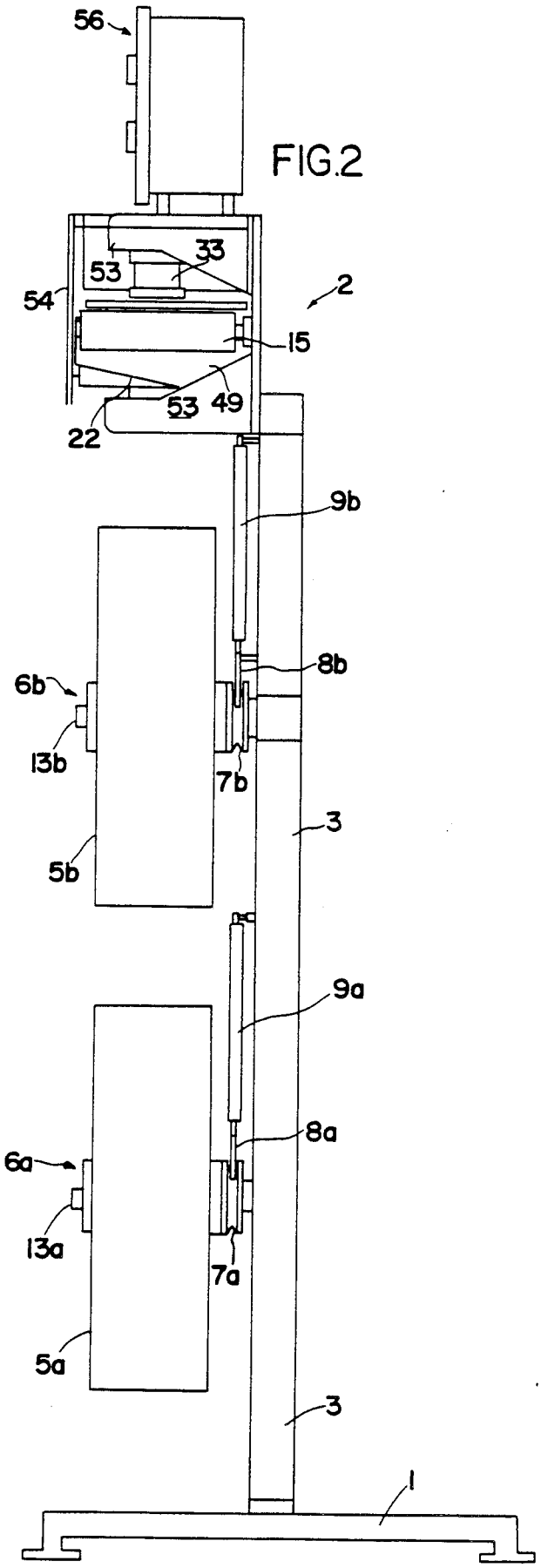
FIG. 2 is a side view of the splicing machine of FIG. 1.

Referring to FIGS. 1 and 2, a continuous web splicing machine in accordance with the invention has a base 1, a splicing station 2 on top of a supporting, vertical column 3, and a continuous web output 4 formed by alternately splicing a stand-by (fresh) roll to a used-up (spent) roll of sheet material, indicated at 5*a* and 5*b*. The machine is particularly suited for splicing together rolls of relatively narrow width which have limited linear footage that must be spliced with a fresh roll frequently, such as used in wash down or sanitized packaging areas of food processing equipment. The rolls 5*a* and 5*b* are typically rolls of paper, plastic, foil, or laminate sheet material.

The machine base 1 can be made of stainless steel rectangular tube with adjustable feet at each corner for leveling on the floor. The vertical column 3 is also stainless steel rectangular tubing bolted to the base 1 and forming a suitable support for the rolls 5*a* and 5*b* on one side thereof (shown in the drawings on the front side). Alternatively, it may support a dual splicing operation with two rolls on each side (front and back) of the vertical column 3.

Each roll is rotatably supported on respective roll cores 6*a* and 6*b* formed with brake drums 7*a* and 7*b* having a V-groove (see FIG. 2) in which brake shoes 8*a* and 8*b* are positioned. The brake shoes are selectively actuatable by respective air cylinders 9*a* and 9*b* to lock or release the roll cores in order hold or run the sheet material from the respective rolls 5*a* and 5*b*. Brake actuation pressure is supplied by an air regulator 10 which sets the pressure at the level shown in a gauge 11 and controlled by the selector switches 12*a*, 12*b*. Each brake shoe can be completely disengaged from the drum for easy removal of the roll core 6*a*, 6*b* from the spindles 13*a*, 13*b* and replacement of the corresponding roll.

Sheet material is unrolled from the lower roll 5*a* and guided over the spacer bar 14 and the roller 15 along a run path to the splicing station 2. Sheet material from the upper roll 5*b* is guided over the roller 22 along a second run path to the splicing station 2. At any time during operation, one of the two sheets is running as an output web guided over the output roller 16, while a leading edge of the other sheet is held in stand-by condition at the splicing station. The output web from the output roller 16 is looped around a dancer or takeup roller 17 and a final roller 18 to a downstream processing station, as indicated at numeral 4.

In the preferred embodiment, the splicing station has dual pairs of holders and cutters in order to allow a spent roll to be spliced to a fresh roll alternately from either the upper or lower roll 5*a*, 5*b*. The splicing station 2 includes a pair of upper and lower pressure bars 27, 23 having respective upper and lower cutter knives 28, 24 and resilient pressure pads 29, 25 formed therewith. The pressure bar assembly 27, 28, 29 is operated by a pneumatic cylinder 30, and the assembly 23, 24, 25 by the cylinder 26. Although this example is implemented with pneumatic controls, it is understood that electronic solenoid or digital motor controls may be also used. An upstream holder assembly on the upper run path, having a holder bar 31, pad 32, and control cylinder 33 is paired opposite a holder assembly on the lower run path having a holder bar 34, pad 35, and control cylinder 36. Similarly, a pair of downstream holder assemblies 40, 41, 42 and 37, 38, 39 are provided for the upper and lower run paths, respectively. The holder assemblies are shown oriented vertically, but may be oriented horizontally as well as more than one orientation is possible.

The operation of the splicing station will now be described for the mode of operation wherein the lower roll 5*a* has been running and is almost spent and the leading edge of a fresh sheet from the upper roll 5*b* is to be spliced to it. The spent sheet from the lower roll 5*a* is guided along the upper run path defined by rollers 15 and 16. The fresh sheet from the upper roll 5*b* is guided along the lower run path defined by rollers 22 and 16. The leading edge of the fresh sheet, indicated in FIG. 1 at numeral 44*a*, is positioned for splicing on the pressure pad 25, and has an adhesive surface formed thereon by prior placement of a double-sided adhesive tape which faces the opposite pressure pad 29.

The mode of splicing the fresh sheet from the lower run path to the sheet on the upper run path is set by setting the switch 45 and pressing the holder actuating button 46. This operates to extend the pneumatic cylinder 36 to clamp the fresh sheet on the lower run path in place between pad 34 and a stationary plate 49 between the two run paths such that the leading edge and adhesive tape is in place at the splicing position 44*a*. If the sheet is not properly clamped by the holders, the release button 47 can be pressed and the fresh sheet can be repositioned.

The splicing operation is initiated by pressing a "start" button 48 on the control panel 56, which actuates upstream holder cylinder 33 on the upper run path to stop the sheet from the lower roll 5*a* from unwinding. Pneumatic controls then automatically sequentially activate downstream holder pad 42 to clamp the spent sheet against the holder pad 39, while cylinder 30 is actuated to move pad 27 and the upper knife 28 downward past the stationary knife 50, thereby cutting a trailing end of the spent sheet off from the roll 5*a* and pressing it into adhesive contact with the leading end of the fresh sheet positioned on the pad 25. Cylinders 42, 30 and 36 then retract to allow the fresh sheet to be unwound on the lower run path to continue the output to the processing station 4. In practical implementation, the total splicing time takes less than 2 seconds.

During the splicing operation, the dancer roller 17 is lifted on pivotable arm 51 to allow the looped length of the web to be used so that a continuous output is provided at a constant velocity to the processing station 4 despite the temporary stoppage of the spent sheet and splicing to the fresh sheet. Cylinder 33 is kept extended to hold the cut-off spent sheet from uncontrolled unwinding, until the release button 47 is pressed to release the spent sheet for replacement by a new roll. The new roll can next be spliced to the sheet from the upper roll 5*b* during the next splicing operation by perform the opposite sequence of the procedure described above.

Safety features of the preferred machine include side shields 53 on both sides of the splicing station, and a transparent front door 54 which is hinged at the top edge and operates to shut down the splicing operation when the trip switch 55 is activated.

Figure 3:
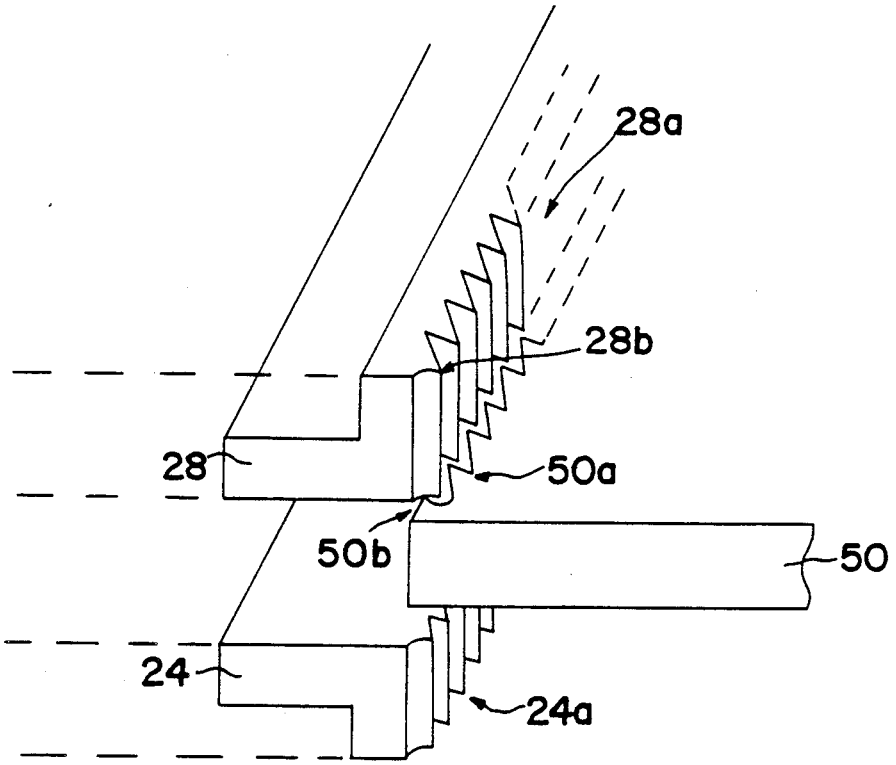
FIG. 3 is a detailed schematic view of the serrated cutter of the preferred embodiment.

In FIG. 3, the movable upper and lower knives 28 and 24 are shown relative to the stationary knife 50 on the stationary plate 49. The knives have complementary serrated edges 28*a*, 24*a*, 50*a* for an efficient cutting action from either one of the upper and lower sides. In accordance with a further aspect of the invention, the knives each have a hooked (curved) tooth on one end of the serrated edges, as indicated at numerals 28*b* and 50*b*. This allows the serrated edges to cut the paper more effectively by biting into the paper and severing it, as compared to the conventional shear action which requires a very precise alignment between the stationary and movable knives.

Other modifications and variations are of course possible in light of the above-disclosed principles of the invention, and it is intended that all are included within the spirit and scope of the invention as defined in the claims appended hereto.

I claim:

1. A continuous web splicing machine comprising:

a base, and a vertical column extending upright from said base;

a splicing station positioned at a top end of said vertical column and having a splicing station therein for splicing a trailing end of a spent roll of sheet material to a leading end of a fresh roll of sheet material in order to supply a continuous output web of sheet material at an output end thereof;

first and second roll supports on said vertical column positioned one above the other between said base and said top end of said vertical column for rotatably mounting first and second rolls holding first and second webs of sheet material thereon, respectively;

first and second guide means for guiding the first and second webs of sheet material from the first and second rolls, respectively, along first and second paths along one lateral side of said vertical column to the splicing station at said top end of said vertical column;

the splicing station including holding means and cutting means and controls for automatically operating the same; and output guide means for guiding a continuous web of sheet material from said splicing station, wherein said holding means of said splicing station includes a first holder for holding a leading end of the web of a fresh one of said two rolls of sheet material in a splicing position, said leading end having an adhesive layer thereon facing toward the web of a spent other one of said two rolls of sheet material, and a second holder which is operable to temporarily hold the web of the spent roll in the splicing position facing opposite the leading end of the web of the fresh roll, said cutting means being operable to cut off a trailing end of the web of the spent roll and adhesively join it to the leading end of the web of the fresh roll, and wherein said output guide means includes a loop holder for holding a loop of the output web of sufficient length so that the web is continuously output even while the web of the spent roll is temporarily held during the splicing operation, said loop holder including a pivotable arm having a pivot end mounted to said vertical column and a free end pivotably movable along an opposite lateral side of said vertical column from that of said first and second paths of said webs of sheet material.

2. A splicing machine according to claim 1, wherein said controls are pneumatically operated controls.

3. A splicing machine according to claim 1, wherein said controls are operated in timed automatic sequence.

4. A splicing machine according to claim 1, wherein said roll supports include respective brakes for selectively locking and releasing the unwinding of the rolls.

5. A splicing machine according to claim 1, wherein said loop holder includes a dancer roller on the end of a pivotable arm for taking up the loop length and releasing it during a splicing operation.

6. A splicing machine according to claim 1, wherein said loop holder holds a length of output web sufficient to allow a continuous web output at a constant velocity during the splicing operation.

7. A splicing machine according to claim 1, wherein said first and second guide means includes separate input rollers and a common output roller of said splicing station.

8. A splicing machine according to claim 1, wherein said splicing station includes a transparent safety door, and a trip switch which deactivates the machine when the door is opened.

9. A splicing machine according to claim 1, wherein said cutting means includes a movable knife and a stationary knife, each of which have a complementary serrated edge with a hooked tooth on said serrated edge for biting into the sheet material and severing it.

10. A continuous web slicing machine comprising:

first and second roll supports for rotatably mounting first and second rolls holding first and second webs of sheet material thereon, respectively;

first and second guide means for guiding the first and second webs of sheet material from the first and second rolls, respectively, along first and second paths to a splicing station;

the splicing station including holding means and cutting means positioned along a horizontal splicing path for the webs of sheet material running from an upstream end to a downstream end thereof, for splicing a trailing end of the web of a spent roll of sheet material to a leading end of the web of a fresh roll of sheet material entering from the upstream end in order to supply a continuous output web of sheet material at the output end thereof; and output guide means for guiding a continuous web of sheet material from said splicing station, wherein said holding means of said splicing station includes:

(a) first and second upstream holders spaced apart in a vertical direction facing opposite each other and having a central stationary plate extending in parallel with said horizontal splicing path so as to define a first web holding path between said first upstream holder and said stationary plate on one side thereof and a second web holding path between said second upstream holder and said stationary plate on an opposite side thereof, wherein each one of said first and second upstream holders is selectively operable for holding an upstream portion of the web of a fresh roll on the corresponding holding path such that a leading end thereof is held at a splicing position, said leading end having an adhesive layer thereon facing toward the web of the spent roll, and, alternatively, for intermittently holding an upstream portion of the web of a spent roll for a splicing operation;

(b) first and second downstream holders for intermittently holding downstream portions of the webs of the two rolls for a splicing operation; and (c) first and second pressure members located at a splicing position between said upstream and downstream holders, each of said pressure members having a pressure pad at a downstream part thereof and a knife edge at an upstream part thereof which is aligned with a proximate end of said stationary plate, said pressure members being spaced apart in the vertical direction facing opposite each other and each being alternately movable to press a trailing end of the web of a spent roll into adhesive contact with the adhesive layer on the leading end of the web of the fresh roll, by the pressure pad thereof being moved into contact with the pressure pad of the other pressure member, and simultaneously to cut the trailing end of the web off from the remainder of the spent roll, by the knife edge thereof moving past the proximate end of the stationary plate.

11. A splicing machine according to claim 10, further comprising controls for selectively operating said first and second upstream holders, first and second downstream holders, and first and second pressure members alternatively in correspondence with the splicing of webs of fresh and spent rolls held on said first and second roll supports.

12. A splicing machine according to claim 10, wherein said knife edges of said pressure members and said proximate end of said stationary plate have complementary serrated edges with hooked teeth formed on one end of the respective edges for biting into the sheet material and severing it.

* * * * *